US010691056B2

(12) United States Patent
Noguchi

(10) Patent No.: US 10,691,056 B2
(45) Date of Patent: Jun. 23, 2020

(54) IMAGE FORMING SYSTEM

(71) Applicant: RISO KAGAKU CORPORATION, Tokyo (JP)

(72) Inventor: Yoshifumi Noguchi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 96 days.

(21) Appl. No.: 15/690,977

(22) Filed: Aug. 30, 2017

(65) Prior Publication Data

US 2018/0088511 A1 Mar. 29, 2018

(30) Foreign Application Priority Data

Sep. 27, 2016 (JP) ..... 2016-188425

(51) Int. Cl.

| | |
|---|---|
| ***G03G 15/00*** | (2006.01) |
| ***B41J 13/00*** | (2006.01) |
| ***B65H 31/10*** | (2006.01) |
| ***B65H 31/38*** | (2006.01) |
| ***B41J 13/10*** | (2006.01) |

(52) U.S. Cl.

CPC ..... *G03G 15/6552* (2013.01); *B41J 13/0018* (2013.01); *B41J 13/0036* (2013.01); *B41J 13/106* (2013.01); *B65H 31/10* (2013.01); *B65H 31/38* (2013.01); *G03G 15/6502* (2013.01); *B65H 2405/15* (2013.01); *B65H 2511/13* (2013.01); *B65H 2511/20* (2013.01); *B65H 2511/30* (2013.01); *B65H 2513/40* (2013.01);

(Continued)

(58) Field of Classification Search

CPC ..... B65H 31/04

See application file for complete search history.

(56) References Cited

U.S. PATENT DOCUMENTS 3,982,751 A * 9/1976 Obenshain ..... B65H 31/38 271/221

5,390,907 A * 2/1995 Dole ..... B65H 31/10 271/207

(Continued)

FOREIGN PATENT DOCUMENTS

| | | |
|---|---|---|
| JP | 2008-201590 | 9/2008 |
| JP | 2014-061978 | 4/2014 |

OTHER PUBLICATIONS

Official Communication issued in European Patent Application No. 17192180.2, dated Feb. 19, 2018.

*Primary Examiner* — Jennifer E Simmons

(74) *Attorney, Agent, or Firm* — Greenblum & Bernstein, P.L.C.

(57) ABSTRACT

In execution of aligning operation in a paper discharge device, every time the number of discharged print sheets reaches the number of aligning-start print sheets, a control unit performs aligning operation while the unit intermittently drives paper feed rollers of an image forming apparatus, to prevent discharge of a print-completed print sheet to a paper discharge table during aligning operation. Further, the control unit intermittently drives an elevation unit such that the print sheet on the top of a paper discharge table is always lower than a paper discharge position of a pair of paper discharge rollers. In execution of high-speed and high-volume printing, it is possible to perform alignment of the print sheet discharged on the paper discharge table without reducing productivity.

2 Claims, 4 Drawing Sheets

(52) U.S. Cl.
CPC .... *B65H 2515/112* (2013.01); *B65H 2801/06* (2013.01)

(56) References Cited

U.S. PATENT DOCUMENTS

| | | | | |
|---|---|---|---|---|
| 2004/0076445 | A1* | 4/2004 | Seto | G03G 15/6582 399/82 |
| 2012/0001385 | A1 | 1/2012 | Hayashi | |
| 2013/0193628 | A1* | 8/2013 | Itogawa | B41J 13/0036 270/1.01 |

* cited by examiner

FIG. 4

| PAPER SIZE | PAPER THICKNESS | NUMBER OF SHEETS UPON ALIGNING START |
|---|---|---|
| A3 | CARDBOARD | 6 |
| | PLAIN PAPER | 8 |
| | THIN PAPER | 10 |
| B4 | CARDBOARD | 8 |
| | PLAIN PAPER | 10 |
| | THIN PAPER | 12 |
| A4 | CARDBOARD | 12 |
| | PLAIN PAPER | 16 |
| | THIN PAPER | 20 |

ALIGNING OPERATION TABLE

・CARDBOARD: EQUAL TO OR GREATER THAN 80 g/ $m^2$
・PLAIN PAPER:
EQUAL TO OR GREATER THAN 50 g/ $m^2$ AND LESS THAN 80 g/ $m^2$
・THIN PAPER: LESS THAN 50 g/ $m^2$

IMAGE FORMING SYSTEM

TECHNICAL FIELD

The present invention relates to an image forming system having an image forming apparatus which performs printing on a print sheet as a printing medium and a paper discharge device which stacks print sheets discharged from the image forming apparatus.

BACKGROUND OF ART

Conventionally, in an image forming system for performing desired printing on a print sheet as a recording medium, when printing a large number of sheets (e.g., 500 to several thousand sheets) in consideration of productivity, an image forming apparatus capable of print processing at a high speed equal to or higher than 100 PPM (pages per minute) is known.

In high-speed and high-volume printing as above, as a post-processing device for the image forming apparatus, a paper discharge device capable of high-speed paper discharge in correspondence with the print speed is connected to the image forming apparatus.

In this type of paper discharge device, the print sheets subjected to the high-speed and high-volume printing are discharged in approximately horizontally toward a paper discharge table. The print sheets fall in a vertical direction, and the sheets are sequentially stacked on the paper discharge table. When the print sheets are simply discharged, the edges of the stacked paper sheets are not aligned. The print sheet pile easily collapses with an increase in the number of stacked sheets.

Further, the print sheet pile may be subjected to aligning operation with a regulating member (fence) in accordance with paper discharge speed. However, to conduct the aligning operation in accordance with high-speed paper discharge, it is necessary to enlarge a fence driving motor, which enlarges the entire device.

A paper discharge device disclosed in Patent Literature 1 has a configuration to suppress shifts of stacked print sheets. The device has fences for alignment fixedly provided in positions, slightly away from the positions of the respective ends of a print sheet placed on the table (the front side end in a paper discharge direction, the rear side end in the paper discharge direction, and ends in a print sheet width direction orthogonal to the paper discharge direction), in consideration of movement of print sheets upon paper discharge.

Patent Literature 1: Japanese Unexamined Patent Application Publication No. 2014-61978

SUMMARY OF INVENTION

Technical Problem

However, in the device in Patent Literature 1, since the fences for alignment are fixedly provided in slightly expanded positions from the size of the print sheet in consideration of movement of the print sheets, the space surrounded by the respective fences is wider than the size of the print sheet. There has been a possibility that print sheet alignment cannot be smoothly performed since the condition of paper discharge is not stabilized in accordance with type (thickness (basis weight) or size) of print sheet or paper discharge speed.

Further, when the discharged print sheet is thin paper (e.g., the basis weight is less than about 50 g/m$^2$), since the print sheet lacks firmness, when a part of the ends is put on the fence, it leans against the fence and does not move away from the fence. Then the next print sheet is stacked on the print sheet partially placed on the fence. Thus the print sheets of the pile are not aligned.

The present invention has been made in consideration of the above situation, and provides an image forming system in which a print sheet pile, aligned with high accuracy, is formed upon paper discharge of print sheets subjected to high-speed and high-volume printing, without enlarging the paper discharge device.

Solution to Problem

The image forming system according to a first aspect of the invention includes:

an image forming apparatus having a paper feed unit that feeds a print sheet and a printing unit that performs printing on the print sheet fed from the paper feed unit;

a paper discharge device having: a paper discharge table where the print sheet discharged from the image forming apparatus is stacked in a horizontal state; an aligning unit that independently aligns a front end and a rear end of the print sheet discharged on the paper discharge table in a paper discharge direction, and side ends on the both sides of the print sheet in a width direction orthogonal to the paper discharge direction; and an elevation unit that moves up/down the paper discharge table; and a control unit that controls paper feed operation with the paper feed unit and printing operation with the printing unit in the image forming apparatus, and aligning operation with the aligning unit and elevation operation with the elevation unit in the paper discharge device, wherein every time a predetermined number of print-completed print sheets are discharged from the image forming apparatus to the paper discharge table, the control unit drives the aligning unit to align the print sheets, and intermittently drives the elevation unit such that the print sheet on the top of the paper discharge table is equal to or lower than a predetermined height, and wherein the control unit intermittently drives the paper feed unit to stop the paper feed operation with the paper feed unit for predetermined time, at predetermined timing of the aligning operation with the aligning unit.

Further, in the image forming system according to a second aspect of the invention, the aligning unit is provided contactably/separably with respect to the front end, the rear end and the side ends of the print sheet, and when the print sheet discharged from the image forming apparatus is received on the paper discharge table, the aligning unit stands by in a stand-by position extended from a print sheet size, and in the aligning operation, the aligning unit moves away from the stand-by position by a predetermined distance, then moves to an aligning position to be in contact with the front end, the rear end and the side ends of the print sheets from four directions, to perform alignment of the print sheet.

Advantageous Effects of Invention

According to the image forming system according to the first aspect of the invention, even when high-volume printing is performed at a high speed without enlarging the paper discharge device, it is possible to perform aligning operation without conveyance of a new print sheet to a paper discharge table, during the aligning operation with the paper discharge device. It is possible to prevent misalignment and form a print sheet pile where the print sheets are aligned with high accuracy.

According to the image forming system according to the second aspect of the invention, the aligning unit moves away from the stand-by position by a predetermined distance, then the aligning unit moves to the aligning position. Even when the discharged print sheet lacks firmness as in the case of thin paper, the state where the print sheet leans against the aligning unit is solved. Thus it is possible to perform paper aligning operation in a state where the condition of each print sheet is corrected.

BRIEF DESCRIPTION OF DRAWINGS

FIG. 4 illustrates an example of an aligning operation table.

DESCRIPTION OF EMBODIMENTS

Figure 1:
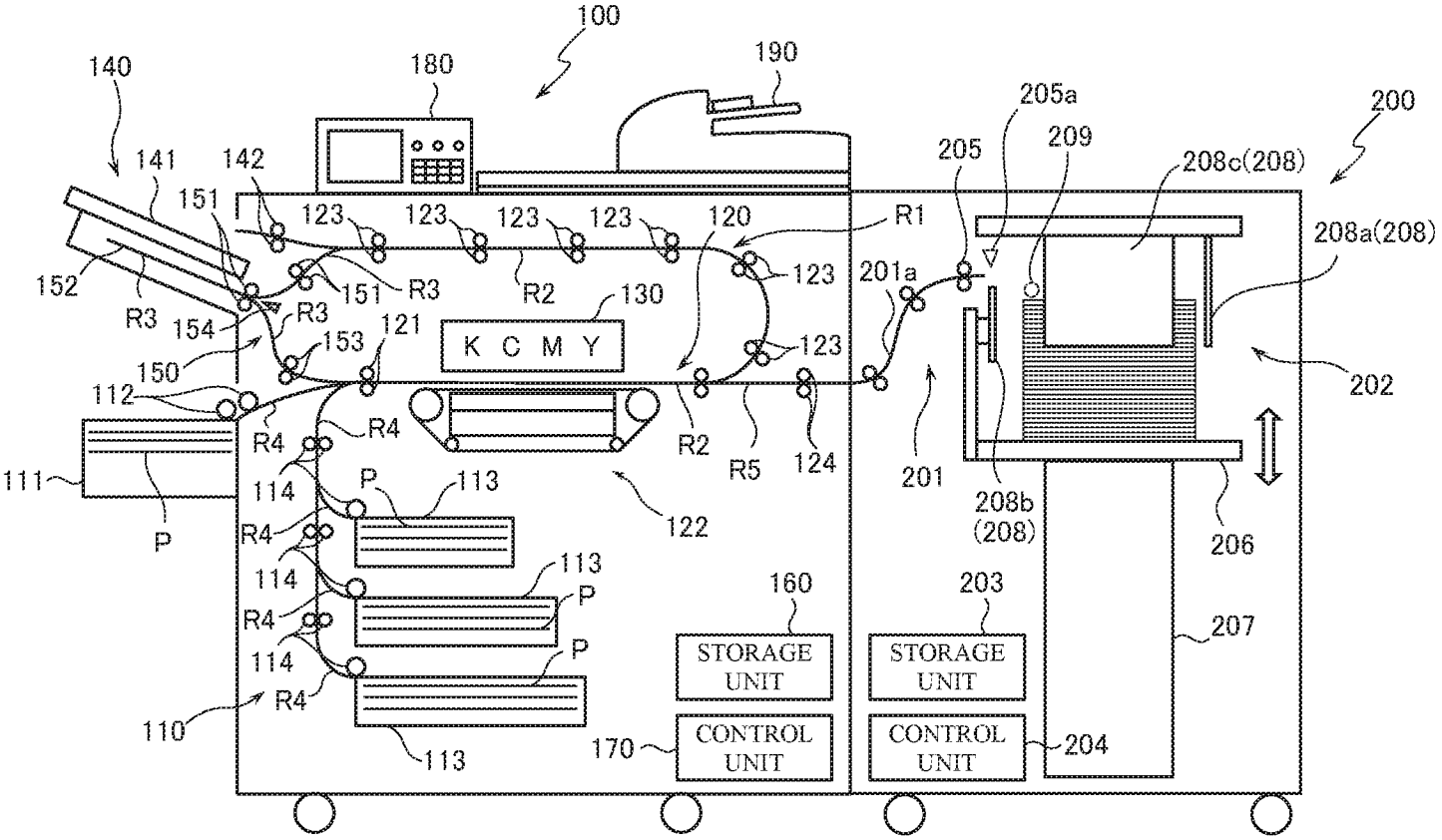
FIG. 1 is a schematic block diagram of an image forming system according to the present invention.

Hereinbelow, a preferred embodiment of the present invention will now be described in detail in accordance with the accompanying drawings. The embodiment does not pose any limitation on the present invention, and all other practicable forms, embodiments and operation technologies conceivable by those skilled in the art based on the embodiment are included in the scope of the invention.

Note that in the specification, in the following description with reference to the attached drawings, when a word "upper", "lower", "left", or "right" is used for indication of direction or position, the direction or position corresponds with "upper", "lower", "left", or "right" to a person who looks at the drawings. In the drawings attached to the specification, in some cases, the scale, the aspect ratio, the shape and the like are appropriately changed from those in real measurement, for the sake of convenience of illustration and perspicuity. However, the drawings show merely an example, and not pose any limitation on the interpretation of the present invention.

Further, in the following description, a "paper discharge direction" is a direction in which a print sheet P as a printed recording medium is discharged through a paper discharge unit 201, and a "width direction" is a direction orthogonal to the paper discharge direction.

[Outline of Image Forming System]

First, an image forming system 1 according to the present invention will be described.

As shown in FIG. 1, the image forming system 1 is a high-speed printing system capable of printing on e.g. five hundreds to several thousand print sheets. The image forming system 1 has an image forming apparatus 100 which performs image formation on a print sheet P in a predetermined size as a recording medium based on a print job; and a paper discharge device 200, as a post-processing device connected to the image forming apparatus 100, which discharges the print sheet P subjected to printing and discharged from the image forming apparatus 100. Note that in the present embodiment, as the image forming system 1, the image forming apparatus 100 and the paper discharge device 200 are separate constituent elements. Further, the respective elements may be integrally formed.

Further, the image forming apparatus 100 and the paper discharge device 200 of the image forming system 1 respectively have functions necessary for high-speed and high-volume printing, i.e., printing on the print sheets P at a high speed (e.g. equal to or higher than 100 PPM) on a large number of print sheets (e.g. 500 to several thousand print sheets) (for example, the image forming apparatus 100 has a high-speed sheet conveying function with a conveying unit 120 and a high-speed print function with a printing unit 130, and the paper discharge device 200 has a high-speed paper discharge function corresponding to image forming speed).

Note that in the present embodiment, as the image forming apparatus 100, an ink-jet printer capable of high-speed and high-volume printing processing is used. Further, various types of image forming apparatuses, e.g. a screen printing machine, a copier, a laser printer, and an MFP (Multi-Function Peripheral) capable of high-speed and high-volume printing processing may be adopted.

[Configuration of Image Forming Apparatus]

The image forming apparatus 100 prints a predetermined image on the print sheet P. The image forming apparatus 100 has a paper feed unit 110, the conveying unit 120, the printing unit 130, a paper discharging unit 140, a reverse unit 150, a storage unit 160, a control unit 170, a setting display unit 180, and an image reading unit 190.

Further, a print job executed by the image forming apparatus 100 according to the present invention is information where various print conditions (the number of sheets, print data (character, image), single-side/double-side printing, color setting (monochrome, multi-color), output magnification, and the like) are set. Further, in the case of a job for high-speed and high-volume printing, the print sheets P in the same size are selected.

This print job is information, including print conditions set with an external terminal such as a PC (Personal Computer) or a server, received via a communication network such as the Internet or Ethernet (registered trademark). In addition, the print conditions may be appropriately set, in information read from a document on a paper medium with the image reading unit 190, with the setting display unit 180, as a print job.

As shown in FIG. 1, in the housing of the image forming apparatus 100, a circulation route R1 is set as a conveyance route for the print sheet P.

The circulation route R1 is a closed-loop type circuit having a normal route R2 to convey the print sheet P on which an image is formed to the paper-discharging unit 140, and a reverse route R3 to reverse the front and rear ends of the print sheet P, on which the image is formed on the surface, in the conveyance direction, then turn the front surface of the print sheet P over and to return the print sheet P to the normal route R2. When the print sheet P is conveyed on the circulation route R1 in the counterclockwise direction in the drawings, it is subjected to image formation in the middle of conveyance, and in accordance with necessity, it is passed through the reverse route R3 and switch-back conveyed. Further, in the circulation route R1, a paper feed route R4 for connection to the paper feed unit 110 is connected to the upstream side of the printing unit 130. Further, in the normal route R2, a discharge route R5, branched from the route toward the paper-discharging unit 140, for discharge of the print-completed print sheet P to the paper discharge device 200 is connected to the downstream side from the printing unit 130. A well-known flapper for route switching (not shown), operated with the control unit 170, is provided in the branching position between the normal route R2 and the discharge route R5. The flapper is used for selecting the normal route R2 or the discharge route R5 as a conveying route for the print sheet P.

The paper feed unit 110 has a vertically movable external paper feed table 111 which is partially exposed to the outside of the housing and which carries a large number of print sheets P, an external paper feed rollers 112 to pick up the print sheets P stacked on the external paper feed table 111 one by one and feed them to the printing unit 130, plural internal paper feed tables 113 provided in the housing of the apparatus, to respectively carry the print sheets P in different sizes, and plural internal paper feed rollers 114 to respectively pick up the print sheets P, designated from the print sheets P stacked on the internal paper feed tables 113, one by one, and feed them to the printing unit 130. The paper feed unit 110 is provided on the uppermost stream side of the conveying route, to feed the print sheet P in a size designated in a print job, to the printing unit 130. When high-speed and high-volume printing is performed as a print job, normally, paper feed is performed from the external paper feed table 111, capable of carrying a large number of print sheets P. Further, it may be configured such that the print sheets P in the same size are sequentially fed out of the plural internal paper feed table 113.

Further, a print sheet sensor having a well-known optical sensor is provided (not shown) between the external paper feed rollers 112 and a registration roller 121 to be described later. When the print sheet P conveyed from the external paper feed rollers 112 is detected, the sensor outputs a detection signal to the control unit 170. Further, the print sheet sensors (not shown) are provided in the vicinity of the downstream side of the respective internal paper feed roller 114. When the print sheets conveyed from the respective internal paper feed rollers 114 are detected, the sensors output detection signals to the control unit 170.

Note that in high-speed and high-volume printing, in the paper feed unit 110, paper feed control is performed based on print intermittent control to prevent misalignment in aligning operation with the paper discharge device 200 (e.g. leaning of the print sheet P on the aligning fence 28 in aligning operation, or drop of the discharged print sheet P after collision with an aligning fence 208 and ejected to the outside the paper discharge table 206), under the control of the control unit 170. The content of the control will be described in detail in the explanation of the control unit 170.

The conveying unit 120 has: registration rollers (secondary paper feed roller) 121, provided in the vicinity of the conjunction of the paper feed route R4 and the reverse route R3, to temporarily stop the print sheet P conveyed from the paper feed unit 110 or the reverse unit 150, perform skew correction on the print sheet P, and convey the print sheet at predetermined timing toward the printing unit 130; a suction conveying unit 122 having plural pairs of conveying rollers, provided under the printing unit 130, to suck the print sheet P conveyed from the registration rollers 121 at a center position while conveying the print sheet; and upper surface conveying rollers 123, having plural pairs of conveying rollers, to U-turn the print sheet P conveyed with the suction conveying unit 122, from the rightward direction to the leftward direction, along the normal route R2. The conveying unit 120 conveys the print sheet P in the circulation route R1 toward a predetermined direction. Note that the registration rollers 121 form a part of a "paper feed unit" in the claims.

Further, in execution of high-speed and high-volume printing as a print job, the conveying unit 120 conveys the print-completed print sheet P, via the discharge route R5 branched from the normal route R2, to the paper discharge device 200. The discharge route R5 has carry-out rollers 124 to carry out the print-completed print sheet P to the paper discharge device 200.

Note that in high-speed and high-volume printing, the conveying unit 120 performs conveyance control based on the print intermittent control, under the control of the control unit 170. The content of the control will be described in detail in the explanation of the control unit 170.

The printing unit 130 has mutually-parallel line-type ink jet heads, corresponding to plural color ink (black (K), cyan (C), magenta (M) and yellow (Y)), having a zigzag arrayed head blocks along a width direction, from the upstream side toward the downstream side in the print sheet conveying direction. The printing unit 130 prints a predetermined image corresponding to a print job with respect to the print sheet P conveyed with the conveying unit 120.

Note that upon high-speed and high-volume printing, the printing unit 130 performs print control based on the print intermittent control, under the control of the control unit 170. The content of the control will be described in detail in the explanation of the control unit 170.

The paper-discharging unit 140 has a paper discharge table 141 on which the discharged print sheet P is stacked, and paper discharge rollers 142 to discharge the print sheet P conveyed with the upper surface conveying rollers 123 toward the paper discharge table 141. The paper-discharging unit 140 is connected to a downstream end of the normal route R2, to discharge the print-completed print sheet P.

The reverse unit 150 has: reverse rollers 151 to temporarily carry in the print sheet P, conveyed with the upper surface conveying rollers 123, in a switch back unit 152, then carry out the print sheet P, and convey the print sheet P to the paper refeed rollers 153; the switch back unit 152 as space to temporarily carry in the print sheet P; the paper refeed rollers 153 to convey the print sheet P, conveyed with the reverse rollers 151, to the registration rollers 121; and a switching gate 154 to guide the print sheet P, conveyed from the upper surface conveying rollers 123, to the reverse rollers 151, and guide the print sheet P, carried out with the reverse rollers 151 from the switch back unit 152, to the paper refeed rollers 153. The reverse unit 150 conveys the print sheet from the normal route R2 into the reverse route R3, to turn the front surface side of the single-side printed print sheet P over, then performs direction reversal processing to reverse the front and rear ends of the print sheet P in the conveyance direction, and conveys the print sheet P along the reverse route R3 to the registration rollers 121.

The storage unit 160 has e.g. a flash memory or a HDD (Hard Disk Drive). The storage unit 160 holds various information (computer programs, application software programs and the like) which is necessary to drive the respective parts of the image forming apparatus 100, and temporarily holds a set print job.

The control unit 170 has e.g. a processor such as a CPU (Central Processing Unit). The control unit 170 reads the computer programs and various application software programs from the storage unit 160 and performs program processing, to perform print processing based on a print job, and further perform operation processing necessary for control processing on the entire image forming apparatus 100 and various processing.

Note that the control unit 170 includes an interface unit (not shown) to receive a print job from an external terminal (not shown) via the communication network, and store the received print job in the storage unit 160.

Further, in the paper discharge device 200, every time a predetermined number of discharged print sheets P are subjected to aligning operation, the control unit 170 performs the print intermittent control to prevent misalignment in aligning operation (e.g. leaning of the print sheet P on the aligning fence 28 in aligning operation, or drop of the discharged print sheet P after collision with the aligning fence 208 and ejected to the outside the paper discharge table 206).

Next, the print intermittent control with the control unit 170 will be described.

In the print intermittent control in the image forming system 1, in synchronization with the execution of aligning operation in the paper discharge device 200, the paper feed unit 110 is intermittently driven, to intermittently convey the print sheet P subjected to the print processing with the printing unit 130, and not to discharge the print sheet P upon aligning operation with the aligning fences 208.

More specifically, the control unit 170 obtains information about the number of aligning-start sheets from an aligning operation table in FIG. 4 to be described later based on the set print conditions (print sheet type, print sheet size, the number of copies and the like). Then, every time the print sheets P corresponding to the number of aligning-start print sheets have been fed from the print start, the control unit 170 stops driving of the paper feed rollers (112 or 114) for required aligning time (e.g. 1 sec) in the paper discharge device 200, to stop the conveyance of the print sheet P. Then, the control unit 170 restarts the driving of the paper feed rollers. Hereinafter the control unit 170 repeats the same control by the completion of the printing for the set number of copies. To improve the safety for misalignment, the time to stop the driving of the paper feed rollers may be obtained by adding minute time to the required aligning time in the paper discharge device.

During the print intermittent control, the driving of the conveyance driving system including the registration rollers 121 and the suction conveying unit 122 in the conveying unit 120 is not stopped but idling-driven. The idling-driving is performed so as to normally perform high-speed and high-volume printing upon restart of feeding of the print sheet P in synchronization of the completion of the aligning operation with the aligning fence 208. During the print intermittent driving, since the paper feed rollers (112 or 114) are intermittently driven, the conveyance of the print sheet P to the printing unit 130 is also performed intermittently. As a result, the print processing is performed intermittently.

Note that as described above, the driving of the paper feed rollers (112 or 114) is stopped by the number of aligning-start print sheets. Since an aligning unit 202 of the paper discharge device 200 is also controlled to perform aligning operation by the number of aligning-start print sheets, the timing of the aligning operation and the intermittent drive control of the paper feed rollers (paper feed unit) are synchronized with each other.

As described above, the control unit 170 performs the intermittent drive control on the paper feed unit 110 in synchronization with the timing of the aligning operation with the paper discharge device 200. This prevents carry-out of the print-completed print sheet P during the aligning operation with the paper discharge device 200, and prevents various inconvenience caused with misalignment.

The setting display unit 180 is an input device having e.g. operation keys, a display/input panel and the like, and is provided on the outside of the housing. In the setting display unit 180, when predetermined operation is performed in setting of various setting information necessary for the image forming apparatus 100 in addition to the user's setting of a print job, an operation signal is outputted to the control unit 170.

The image reading unit 190 has a light source to emit light to irradiate a document, a CCD image sensor to receive reflection light from the document and perform photoelectric conversion and the like. The image reading unit 190 optically reads an image of the document, and generates image data. The image reading unit 190 performs document reading while using a copier function and a scanner function.

[Configuration of Paper Discharge Device]

Next, the configuration of the paper discharge device 200 according to the present embodiment will be described.

Figure 2:
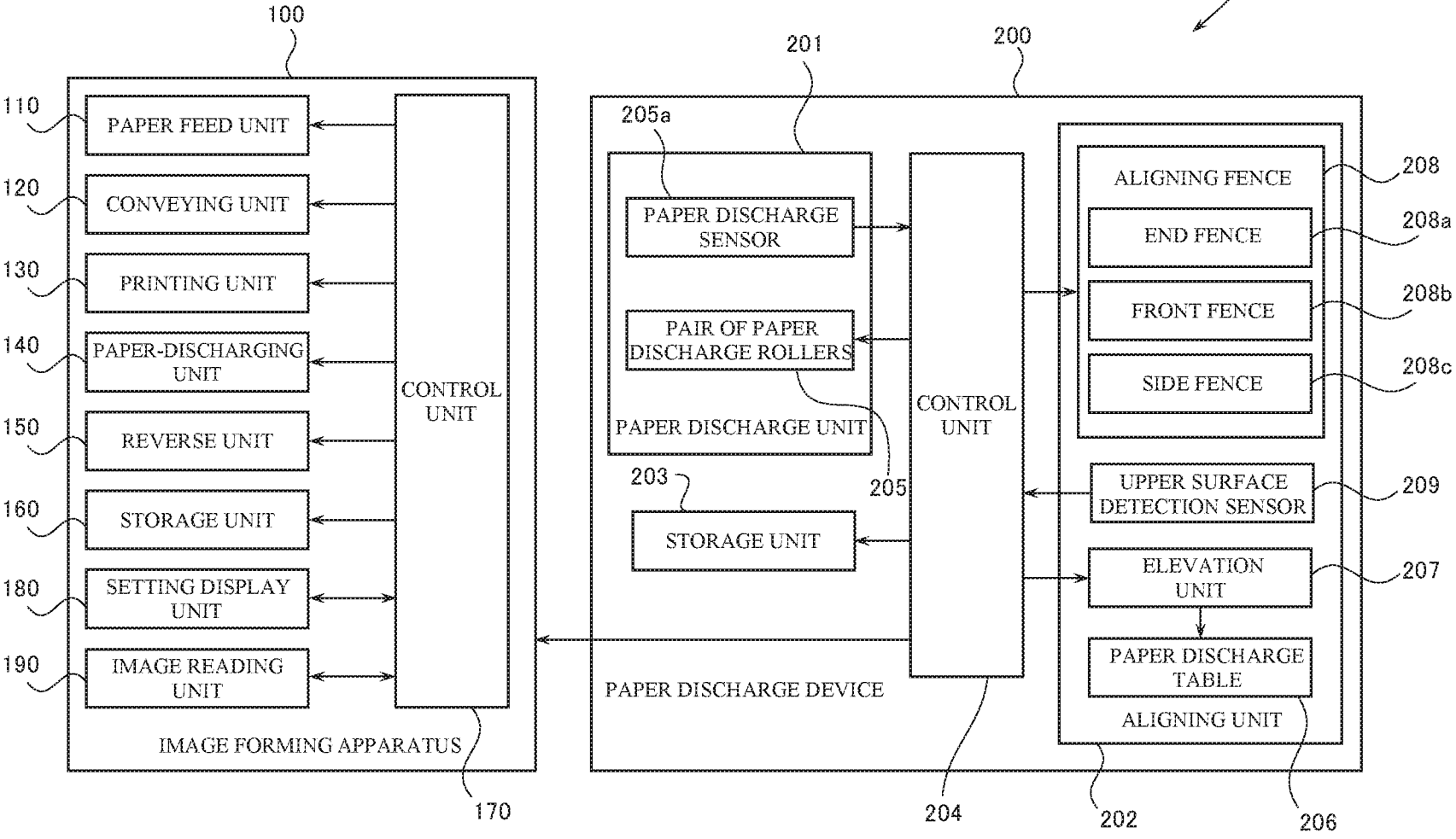
FIG. 2 is a functional block diagram of the image forming system.

As shown in FIG. 1 or 2, when executing high-speed and high-volume printing as a print job, the paper discharge device 200 carries in the print-completed print sheets P via the discharge route R5, then sequentially discharges the print sheets P, thus stacks the print sheets P into a print sheet pile. The paper discharge device 200 has the paper discharge unit 201, the aligning unit 202, a storage unit 203, and a control unit 204.

The paper discharge unit 201 has a pair of paper discharge rollers 205 to carry in the print-completed print sheet P discharged from the image forming apparatus 100 via a carry-in route 201*a*, and discharge the print sheet toward the paper discharge table 206.

The pair of paper discharge rollers 205 discharges the print sheet P at the same speed as the print speed, in correspondence with high-speed and high-volume printing with the image forming apparatus 100, under the control of the control unit 204. The paper discharge speed with the pair of paper discharge rollers 205 in high-speed and high-volume printing is a high speed (e.g. 100 PPM or higher). In this high-speed paper discharge, before the air included between the discharged print sheet P and the print sheet P on the top of the print sheet pile stacked on the paper discharge table 206 is eliminated, the next print sheet P is discharged. Accordingly, in some cases, the position of the print sheet P stacked on the print sheet pile is slightly shifted due to the air.

Further, a paper discharge sensor 205*a* to detect passage of discharged print sheet P is provided on the downstream side of the pair of paper discharge rollers 205 in the paper discharge direction. Although the paper discharge sensor 205*a* is a print sheet sensor having a well-known reflection sensor, an optical sensor may be used. When the paper discharge sensor 205*a* detects the print sheet P passed in the vicinity of the sensor, it outputs, to the control unit 204, a detection signal indicating the passage of the print sheet P. That is, when the detection signal is outputted, the control unit 204 is notified of the discharge of the print sheet P to the paper discharge table 206.

The aligning unit 202 has: a paper discharge table 206 on which the print sheets P discharged from the paper discharge unit 201 are stacked; an elevation unit 207 to appropriately move up/down the position of the paper discharge table 206 in correspondence with the height of the print sheet pile; the aligning fences 208 as an aligning unit, in contact with the four sides of the discharged print sheet P (an end of the print sheet P on the front side in the paper discharge direction (hereinbelow, simply "front end Pa"), another end of the print sheet P on the rear side in the paper discharge direction (hereinbelow, simply "rear end Pb"), ends of the print sheet P on both sides in a print sheet width direction orthogonal to the paper discharge direction (hereinbelow, simply "side ends Pc")), to align the print sheet pile on the paper discharge table 206 in a predetermined position; and an upper surface detection sensor 209 to detect presence/absence of the print sheet on the top of the paper discharge table 206.

The paper discharge table 206 is configured such that a mount surface for the print sheet P is approximately horizontal. The paper discharge table 206 moves up/down intermittently in a direction vertical to the mount surface by a predetermined amount (distance) based on the number of discharged print sheets P and/or the number of times of aligning operation.

The elevation unit 207 is controlled using the output from the upper surface detection sensor 209 provided in the paper discharge device 200. The elevation unit 207 elevation-drives the paper discharge table 206 such that the print sheet P on the top of the paper discharge table 206 does not exceed the paper discharge position of the pair of paper discharge rollers 205 (projecting position of the print sheet P) in the vertical direction while the distance between the position of the top print sheet P in the vertical direction and the paper discharge position is within a predetermined range. The elevation unit 207 is drive-controlled with the control unit 204.

As the elevation timing, the paper discharge table 206 is not moved up/down during the aligning operation with the aligning fence 208. There is a possibility that when the paper discharge table 206 is moved up/down during aligning operation, the print sheet P collides with the aligning fence (s) 208 and protrudes from the paper discharge table 206. Further, the elevation frequency of the paper discharge table 206 is appropriately set in correspondence with thickness or size of discharged print sheet P.

The aligning fences 208 as the aligning units are provided independently contactably/separably with respect to the four sides (the front end Pa, the rear end Pb, and the two side ends Pc) of the print sheet P discharged on the paper discharge table 206. A mechanism to drive each aligning fence 208 forward/rearward is well known and illustration and explanation of the mechanism will be omitted.

Figure 3A:
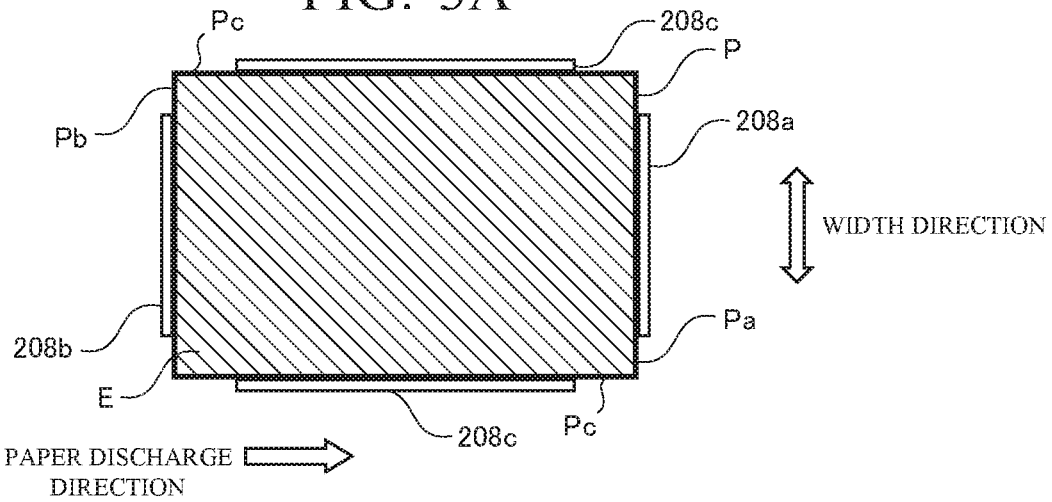
FIG. 3A illustrates a state where aligning fences are in aligning positions.
Figure 3B:
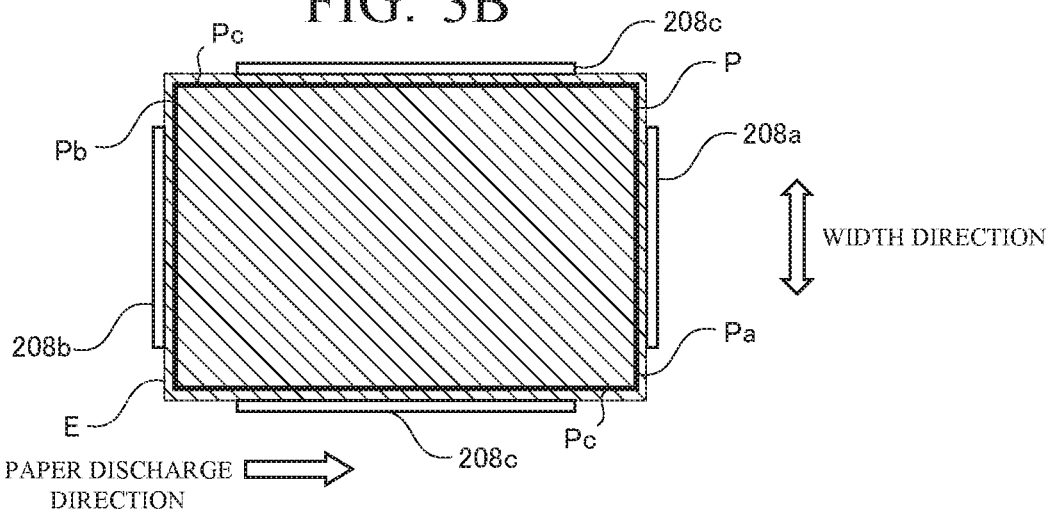
FIG. 3B illustrates a state where the aligning fences are in stand-by positions.
Figure 3C:
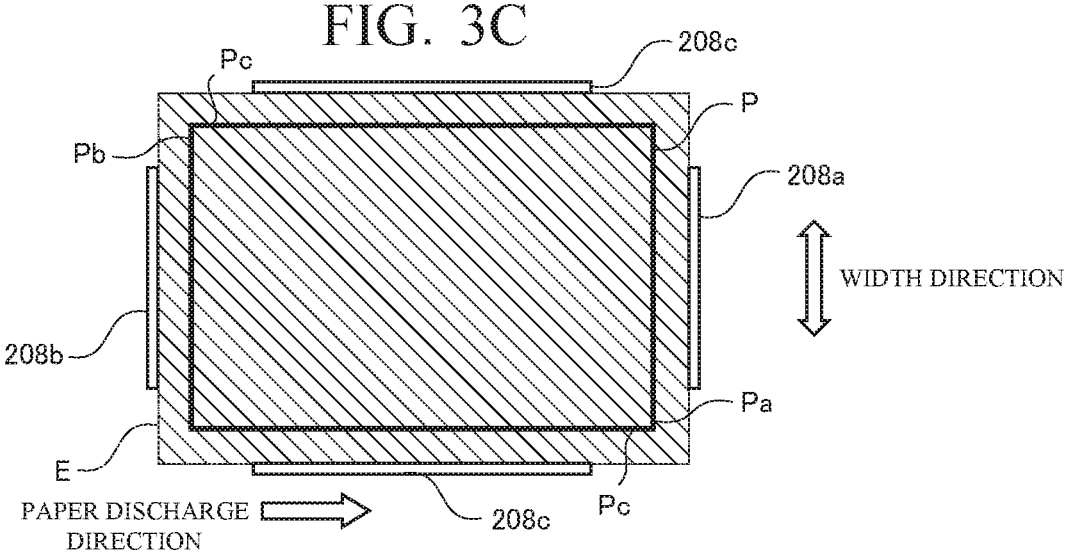
FIG. 3C illustrates a state where the aligning fences are in separating positions.

In the present embodiment, each aligning fences 208 is a plate type fence having a surface to be in contact with the print sheet P. As shown in FIGS. 3A to 3C, the aligning fences 208 include an end fence 208*a* to be in contact with the front end Pa of the print sheet P, a front fence 208*b* to be in contact with the rear end Pb of the print sheet P, and a pair of side fences 208*c* to be in contact with the side ends Pc of the print sheet P.

Among the aligning fences 208, the end fence 208*a* and the side fences 208*c* are provided movably in contacting/separating directions with respect to the front end Pa and the side ends Pc of the discharged print sheet P (in FIG. 1, the end fence 208*a* is movable in leftward/rightward direction, and the side fences 208*c* are movable in backward/frontward direction in the drawing), with respect to the device housing part above the paper discharge table 206.

In the device housing, the upper surface detection sensor 209 to detect the presence/absence of the print sheet P on the top of the paper discharge table 206 is fixedly provided with respect to the device housing above the paper discharge table 206. The upper surface detection sensor 209 is a well-known sensor having a transmission type optical sensor including a light emitting part and a photoreception part. Note that for the sake of convenience, illustration of an attachment structure of the upper surface detection sensor 209 with respect to the paper discharge device 200 main body or the like will be omitted.

In FIG. 1, the light emitting part and the photoreception part are respectively provided in positions not overlapped with the side fences 208*c* and in overlapped positions on front side and back side of the drawing. The position where the upper surface detection sensor 209 detects the print sheet P is set to a position lower than the paper discharge position of the pair of paper discharge rollers 205 (projecting position of the print sheet P) in the vertical direction. The detection signal from the upper surface detection sensor 209 is outputted to the control unit 204.

Further, the front fence 208*b* is provided movably in a contactable/separable direction with respect to the rear end Pb of the discharged print sheet P (the leftward/rightward direction in FIG. 1), with respect to the device housing part below the pair of paper discharge rollers 205.

Further, regarding the aligning fences 208, to align the print sheet pile on the paper discharge table 206 and the respective ends Pa to Pc of the print sheet P discharged on the print sheet pile, aligning position(s), stand-by position(s) and separating position(s), to be described later, are set such that the aligning fences 208 move among these positions.

Note that since the aligning position, the stand-by position and the separating position are appropriately set in correspondence with size of discharged print sheet P, the positions are determined by print job.

(Aligning Position)

As shown in FIG. 3A, in the aligning positions, the fences are in contact with the respective ends Pa to Pc of the discharged print sheet P, to align the print sheet P. Since a plane area E of the space surrounded by the aligning fences 208 is appropriately set in correspondence with size of the discharged print sheet P such that the area E is approximately the same as the size of the discharged print sheet P, the aligning position is variable by print job.

(Stand-by Position)

As shown in FIG. 3B, when the aligning operation is not performed, the aligning fences 208 stand by in the stand-by positions (i.e., the positions of the aligning fences 208 when the print sheet P is discharged). The stand-by positions are set such that the plane area E of the space surrounded by the aligning fences 208 is slightly larger than that of the aligning positions, in consideration of play of the discharged print sheet P. In the present embodiment, the stand-by positions of the aligning fences 208 are about 1 to 1.5 mm away from the size of the discharged print sheet P.

(Separating Position)

As shown in FIG. 3C, when the aligning operation is started, the aligning fences 208 temporarily move to the separating positions. The separating positions are set such that the plane area E of the space surrounded by the aligning fences 208 is slightly larger than that in the stand-by positions. In the present embodiment, the separating positions of the aligning fences 208 are about 6 to 6.5 mm (i.e., farther about 5 mm from the stand-by positions) away outward from the aligning positions. With movement of the aligning fences 208 from the stand-by positions to the separating positions upon aligning operation, it is possible to solve the leaning of the print sheet P against the aligning fence 208 and correct the condition of the print sheet P on the paper discharge table 206 to an alignable state.

The aligning operation of the aligning fences 208 is performed when the print sheet P is not discharged from the pair of paper discharge rollers 205.

More particularly, first, the aligning fences 208 in the stand-by positions are moved to the separating positions. At this time, with movement of the aligning fences 208 further outward from the stand-by positions, the leaning of the print sheet P against the aligning fence 208 is solved, and the condition of the print sheet P is corrected to alignable condition.

Next, the aligning fences 208 moved to the separating positions are moved to the aligning positions. At this time, the respective ends Pa to Pc of the print sheet P are in contact with the respective aligning fences 208, thus the print sheet P is aligned.

Next, the aligning fences 208 moved to the aligning positions are again moved to the stand-by positions. The aligning operation ends, then the aligning fences 208 are in the stand-by positions for next aligning timing.

That is, in the present embodiment, the print sheet P is aligned (print sheet end alignment) by movement of the aligning fences 208 (the stand-by positions→the separating positions→the aligning positions→the stand-by positions). After the aligning operation, the print sheet P is discharged in a state where the aligning fences 208 are in the stand-by positions.

Further, when the print sheet P is a cardboard (e.g., the basis weight is 80 g/m$^2$ or heavier), as the firmness of the paper itself is strong, in some cases, the print sheet P collides with the aligning fence 208 and is ejected outside the paper discharge table 206 due to an inertial force upon discharge. To prevent this inconvenience, the stand-by positions for the aligning fences 208 may be set as the separating positions when the print sheet P is a cardboard. In this case, the aligning operation starts from the separating positions (the separating positions→the aligning positions→separating positions). Since the firmness of the print sheet is strong, the possibility of misalignment due to leaning of the print sheet against the aligning fence 208 as in the case of thin paper is extremely low.

The storage unit 203 having e.g. a flash memory or a HDD (Hard Disk Drive) holds various information (computer programs, application software programs, and the like) to drive the respective parts of the paper discharge device 200. Further, the storage unit 203 holds an aligning operation table regulating alignment frequency in correspondence with type (basis weight (thickness) and size) of print sheet P discharged upon aligning operation.

As shown in FIG. 4, the aligning operation table shows the size and thickness (basis weight) of discharged print sheet P, and the number of aligning-start print sheets (the number of print sheets discharged from the pair of paper discharge rollers 205), with which aligning operation is executable with high accuracy, associated with each other. The number of aligning-start print sheets is a value previously obtained by experiment or the like for alignment of print sheet P discharged from the paper discharge unit 201 with high accuracy. For example, when the print sheet P corresponds to an A3-sized print sheet and is a cardboard (the basis weight is 80 g/m$^2$ or heavier), aligning operation is performed when six sheets are stacked (discharged) on the paper discharge table 206.

Note that the table shown in FIG. 4 shows the numbers of aligning-start print sheets P, as aligning operation start timings, in accordance with combination of size and thickness from three sizes (A3, B4 and A4) of the print sheet P, and three types (cardboard (basis weight: 80 g/m$^2$ or heavier), plain paper (basis weight: 50 g/m$^2$ or heavier and less than 80 g/m$^2$), and thin paper (basis weight: less than 50 g/m$^2$) as the thickness of the print sheet P. However, this does not pose any limitation on the present invention, and it is possible to realize aligning operation with higher accuracy by obtaining further fine information regarding size and thickness of the print sheet P.

The control unit 204 having e.g. a processor such as a CPU (Central Processing Unit) reads computer programs and various application software stored in the storage unit 60, then performs the program processing, to perform control processing on the entire paper discharge device 200. The control unit 204 is connected with the control unit 170 of the image forming apparatus 100 with a signal line (not shown). The control of the image forming apparatus 100 and that of the paper discharge device 200 are performed in synchronization with each other. The control unit 170 and the control unit 204 form a "control unit" in the claims.

The control unit 204 drive-controls the pair of paper discharge rollers 205 such that the paper discharge speed corresponds to the discharge speed of print-completed print sheet P discharged from the image forming apparatus 100. With this configuration, the interval between the print sheets P is fixed while the print-completed print sheets P are conveyed in the discharge route R5 or the carry-in route 201*a*.

Further, when the detection signal from the paper discharge sensor 205*a* is inputted, the control unit 204 compares the number of discharged print sheets P from the paper discharge unit 201, obtained based on the detection signal, with the number of aligning-start print sheets corresponding to the being-discharged print sheet P in the aligning operation table stored in the storage unit 203. When the number of discharged print sheets reaches the number of aligning-start print sheets in the table, the control unit performs aligning operation by sequentially moving the aligning fences 208 (the stand-by positions→the separating positions→the aligning positions→the stand-by positions).

Further, during paper discharge, when the print sheet P on the top of the paper discharge table 206 is detected with the upper surface detection sensor 209, the control unit 204 controls the elevation unit 207 to move down the paper discharge table 206 by a predetermined height at timing of completion of the first aligning operation with the aligning fences 208. Thereafter, again during paper discharge, when the print sheet P on the top of the paper discharge table 206 is detected with the upper surface detection sensor 209, the control unit 204 repeats the above control of the elevation unit 207 to move down the paper discharge table 206, intermittently, such that the print sheet P on the top of the paper discharge table 206 is always positioned lower than the paper discharge position of the pair of paper discharge rollers 205 (projecting position of the print sheet P).

Further, when the number of discharged print sheets is a predetermined number and it is timing for execution of aligning operation, the control unit 204 notifies the control unit 170 of the image forming apparatus 100 of the timing information. The control unit 170, which has stopped the paper feed rollers (112 or 114) at timing before the timing for execution of the aligning operation, checks whether or not the intermittent drive control is normally performed on the paper feed rollers, based on the aligning operation execution timing information from the control unit 204.

Note that in the present embodiment, the paper discharge device has the storage unit 203 and the control unit 204. Further, it may be configured such that the storage unit 160 and the control unit 170 of the image forming apparatus 100 connected with the paper discharge device 200 cover the respective functions of the storage unit 203 and the control unit 204.

[Processing Operation of Image Forming System]

Next, the processing operation of the above-described image forming system 1 will be described.

In the description, the processing operation is performed in the above-described image forming system 1 when printing is performed on A4 sized plain paper, based on a print job set for high-speed and high-volume printing, and the above-described print intermittent control is performed.

First, when a print job is inputted, the control unit 170 obtains information about the number of aligning-start print sheets from the aligning operation table in FIG. 4, via the control unit 204, based on the set print conditions (print sheet type, print sheet size, the number of copies and the like). Further, the control unit 170 obtains required aligning time (e.g. 1 sec) for the paper discharge device 200 from the control unit 204.

Note that more precisely, the required aligning time for the paper discharge device 200 is determined in correspondence with print sheet type and print sheet size, and is stored in the storage unit 203 as in the case of the above-described aligning operation table. Note that the required aligning time is not changed considerably (e.g. to double or greater) in correspondence with print sheet size or the like, it may be fixed time with a margin.

When a job for high-speed and high-volume printing is executed as a print job, a print-completed print sheet P is received via the paper discharge unit 201 from the image forming apparatus 100. The print sheets P are sequentially discharged with the pair of paper discharge rollers 205 to the paper discharge table 206.

Next, in accordance with the detection signal from the paper discharge sensor 205*a*, the number of print sheets discharged from the paper discharge unit 201 is compared with the number of aligning-start print sheets in the aligning operation table stored in the storage unit 203. In this operation example, since the type of print sheet is A4-sized plain paper, the number of aligning-start print sheets is sixteen. Then, when the number of discharged print sheets reaches the number of aligning-start print sheets, information of the status is outputted to the control unit 170.

From the start of printing, every time the number of fed print sheets P reaches the number of aligning-start print sheets, the control unit 170 stops the driving of the paper feed rollers (112 or 114) for as long as required aligning time for the paper discharge device to stop conveyance of the print sheet P. Thereafter, the control unit 170 restarts the driving of the paper feed rollers. The control unit 170 performs the same control until the completion of the printing for the set number of copies.

On the other hand, every time it is detected with the paper discharge sensor 205*a* that the total number of print sheets P discharged on the paper discharge table 206 reaches the number of aligning-start print sheets, the control unit 204 of the paper discharge device 200 drives the aligning fences 208 to perform aligning operation. As described above, every time the number of the fed print sheets P reaches the number of aligning-start print sheets, the control unit 170 stops the driving of the paper feed rollers (112 or 114) for as long as required aligning time for the paper discharge device 200, at timing slightly before the timing of aligning operation with the aligning fences 208. With this configuration, when paper discharge of the number of aligning-start print sheets is performed and aligning operation is performed, the print-completed print sheet P is not discharged to the paper discharge table 206.

The driving of the paper feed rollers (112 or 114) is restarted at timing slightly before the end of the aligning operation, and immediately after the returning of the aligning fences 208 to the stand-by positions, the print-completed print sheet P, subjected to printing with the printing unit 130, is conveyed from the image forming apparatus 100 toward the paper discharge device 200.

Hereinafter, in synchronization with timing at which the number of print sheets discharged with the paper discharge device 200 reaches the number of aligning-start print sheets, print intermittent control is performed with the image forming apparatus 100. With this configuration, it is possible to normally perform aligning operation without conveyance of print-completed print sheet P with the paper discharge device 200 in aligning operation.

On the other hand, upon discharge of print sheets P with the paper discharge device 200, when the top print sheet P on the paper discharge table 206 is detected with the upper surface detection sensor 209, the paper discharge table 206 is moved down by a predetermined height at timing when the first aligning operation thereafter with the aligning fence 208 is completed. As the downward movement control is intermittently repeated, the print sheet P on the top of the paper discharge table 206 is always positioned in the vicinity of and lower than the paper discharge portion (print sheet projecting position) of the pair of paper discharge rollers 205.

As described above, according to the image forming system 1 of the present invention, even in execution of a print job for high-speed and high-volume printing for several thousand copies, it is possible to prevent misalignment in aligning operation caused due to discharge of print sheet during aligning operation. Further, the paper discharge device 200 aligns the respective ends Pa to Pc of the discharged print sheet P on the paper discharge table 206 before the next print sheet P is discharged. Accordingly, in a print job for several thousand copies, it is possible to stack a large number of discharged print sheets P on the paper discharge table 206 in an orderly manner without lowering the productivity.

Further, in execution of aligning operation, by moving the aligning fences 208 from the stand-by positions to receive the print sheet P to the separating positions away from the stand-by positions over a predetermined distance, then to the aligning positions, even when the discharged print sheet P is thin paper (basis weight is less than about 50 $g/m^2$) and lacks firmness and leans against the aligning fence 208, it is possible to solve the leaning of the paper in aligning operation, and it is possible to correct the condition of the print sheet P and perform accurate alignment.

Further, the number of discharged print sheets and the predetermined number of aligning-start print sheets are compared, and aligning operation is performed when the predetermined number of print sheets P have been discharged corresponding to the type of print sheet P. Accordingly, even when the device has a configuration to use various types of print sheets including thin paper and cardboard, it is possible to perform aligning operation at appropriate aligning timing corresponding to the print sheet.

DESCRIPTION OF REFERENCE SIGNS

1 . . . image forming system
100 . . . image forming apparatus
110 . . . paper feed unit
120 . . . conveying unit
130 . . . printing unit
140 . . . paper-discharging unit
150 . . . reverse unit
160 . . . storage unit
170 . . . control unit
180 . . . setting display unit

190 . . . image reading unit
200 . . . paper discharge device
201 . . . paper discharge unit (201*a* . . . carry-in route)
202 . . . aligning unit
203 . . . storage unit
204 . . . control unit
205 . . . pair of paper discharge rollers (205*a* . . . paper discharge sensor)
206 . . . paper discharge table
207 . . . elevation unit
208 . . . aligning fence (208*a* . . . end fence, 208*b* . . . front fence, 208*c* . . . side fence)
209 . . . upper surface detection sensor
P . . . print sheet
Pa . . . front side end of print sheet in paper discharge direction
Pb . . . rear side end of print sheet in paper discharge direction
Pc . . . end of print sheet on side in print sheet width direction
E . . . plane area of space surrounded by aligning fences

The invention claimed is:

1. An image forming system comprising:

an image forming apparatus having a paper feed unit that feeds a print sheet and a printing unit that performs printing on the print sheet fed from the paper feed unit;

a paper discharge device having: a paper discharge table where the print sheet discharged from the image forming apparatus is stacked in a horizontal state; an aligning unit that independently aligns a front end and a rear end of the print sheet discharged on the paper discharge table in a paper discharge direction, and side ends on the both sides of the print sheet in a width direction orthogonal to the paper discharge direction; and an elevation unit that moves up/down the paper discharge table; and a control unit that controls paper feed operation with the paper feed unit and printing operation with the printing unit in the image forming apparatus, and aligning operation with the aligning unit and elevation operation with the elevation unit in the paper discharge device, wherein the aligning unit is provided contactably/separably with respect to the front end, the rear end and the side ends of the print sheet, when the print sheet discharged from the image forming apparatus is received on the paper discharge table, the aligning unit stands ready in a stand-by position extended from a print sheet size, and in the aligning operation, the aligning unit moves from the stand-by position to an aligning position to be in contact with the front end, the rear end and the side ends of the print sheet from four directions, to perform alignment of the print sheet, wherein every time a predetermined number of print-completed print sheets are discharged from the image forming apparatus to the paper discharge table, the control unit drives the aligning unit out of the stand-by position to perform the aligning operation to align the print sheets, and intermittently drives the elevation unit such that the discharged print sheet on the top of the paper discharge table is equal to or lower than a predetermined height, and wherein the control unit intermittently drives the paper feed unit to stop the paper feed operation, with the paper feed unit for a predetermined time, at a predetermined timing of the aligning operation with the aligning unit.

2. The image forming system according to claim 1, wherein in the aligning operation, the aligning unit moves away from the stand-by position by a predetermined distance and then moves to an aligning position to be in contact with the front end, the rear end and the side ends of the print sheet from four directions, to perform alignment of the print sheet.

* * * * *